United States Patent [19]

Dutcher

[11] Patent Number: 4,498,581

[45] Date of Patent: Feb. 12, 1985

[54] BEVERAGE CAN CARTON WITH OPENING PANEL

[75] Inventor: Daniel P. Dutcher, Blaine, Minn.

[73] Assignee: Champion International Corporation, Stamford, Conn.

[21] Appl. No.: 540,377

[22] Filed: Oct. 11, 1983

[51] Int. Cl.[3] ..... B65D 5/46; B65D 75/68

[52] U.S. Cl. ..... 206/427; 206/607; 206/611; 206/615; 229/40; 229/52 B; 229/52 BC

[58] Field of Search ..... 206/139, 141, 165, 169, 206/193, 194, 196, 199, 200, 427, 433, 435, 604–609, 611–615, 616, 617, 621–629, 631, 633; 229/37 R, 40, 52 B, 52 BC

[56] References Cited

U.S. PATENT DOCUMENTS

| | | | |
|---|---|---|---|
| 3,042,194 | 7/1962 | Champlin | 229/40 |
| 3,283,990 | 11/1966 | Tolaas | 229/40 |
| 3,554,402 | 1/1971 | Lock | 229/52 B |
| 3,620,438 | 11/1971 | Wood | 229/DIG. 5 |
| 3,696,990 | 10/1972 | Dewhurst | 229/52 B |
| 4,252,236 | 2/1981 | Roccaforte | 206/607 |
| 4,331,289 | 5/1982 | Killy | 229/52 B |
| 4,396,143 | 8/1983 | Killy | 206/427 |

*Primary Examiner*—George E. Lowrance
*Assistant Examiner*—Jimmy G. Foster
*Attorney, Agent, or Firm*—Evelyn M. Sommer; William W. Jones

[57] ABSTRACT

The carton is designed for carrying a plurality of beverage cans and includes a tear away portion which is disposed partially in the carton top wall and partially in an adjacent side wall. The top wall of the carton is formed by overlapping top wall panels which are adhesively secured together. Finger gripping openings are disposed in the outer top wall panel, and reinforcing tabs are formed on a free edge of the inner top wall panel to strengthen the weight bearing central portion of the top wall of the carton. The tear away portion of the carton is formed by a first plurality of cut score lines positioned in the outer top wall panel and by a second plurality of cut score lines positioned in the side wall of the carton. The respective cut score lines are offset from the fold line which interconnects the side wall and outer top wall panel so that the fold line will not buckle when the filled carton is carried via the finger grip openings.

2 Claims, 6 Drawing Figures

BEVERAGE CAN CARTON WITH OPENING PANEL

This invention relates to a paperboard carton which is designed for carrying a plurality of beverage cans. More particularly, the carton of this invention includes a tear away access or opening portion formed in the top and side walls and includes a reinforced weight bearing top wall having finger grip openings formed therein.

Cartons which are designed to hold a plurality of beverage cans, as for example, twelve or twenty-four cans, are known in the prior art. Such cartons are provided with some sort of hand grip structure which may be a form of strap handle, or may comprise finger grip openings formed usually in the top wall of the carton. The more recent of these cartons include closed end walls so that a portion of the carton must be torn to gain access to the beverage cans. Generally, the tearing portion of the carton will be defined by rupturable cut score lines formed in the carton walls. The tearing portion can be hingedly connected to the remainder of the carton or completely removed from the carton, and once torn, it provides a dispensing opening in the carton whereby cans can be removed singly from the carton.

The carton of this invention is provided with a simplified yet sturdy hand grip structure and is also provided with a tear open portion which extends from the top panel into an adjacent side panel. The tear open portion is defined by a plurality of cut score lines formed in the top and side walls of the carton. There is a gap in the cut score lines at the fold line which interconnects the side wall and the top wall so that the carton will not buckle at the fold line when it is carried full of cans by means of the hand grip structure. When the carton is opened, the paperboard material shears along its grain direction through the fold line area. Thus, when the carton is opened, the top wall ruptures along the cut score lines, then the carton shears along its grain direction through the fold line area, and then the side wall ruptures along the cut score lines formed therein. Thus, the sheared parts of the carton interconnect respective cut score line groups.

It is, therefore, an object of this invention to provide a beverage can carton which has a simplified yet sturdy hand grip structure.

It is a further object of this invention to provide a carton of the character described having a tear away opening portion which extends from a top wall of the carton into an adjacent side wall.

It is an additional object of this invention to provide a carton of the character described which can be carried by the hand grip structure without buckling along the fold line which joins the top and side walls in which the opening portion is contained.

These and other objects and advantages of this invention will be more readily apparent from the following detailed description of a preferred embodiment thereof when taken in conjunction with the accompanying drawings in which.

Figure 1:
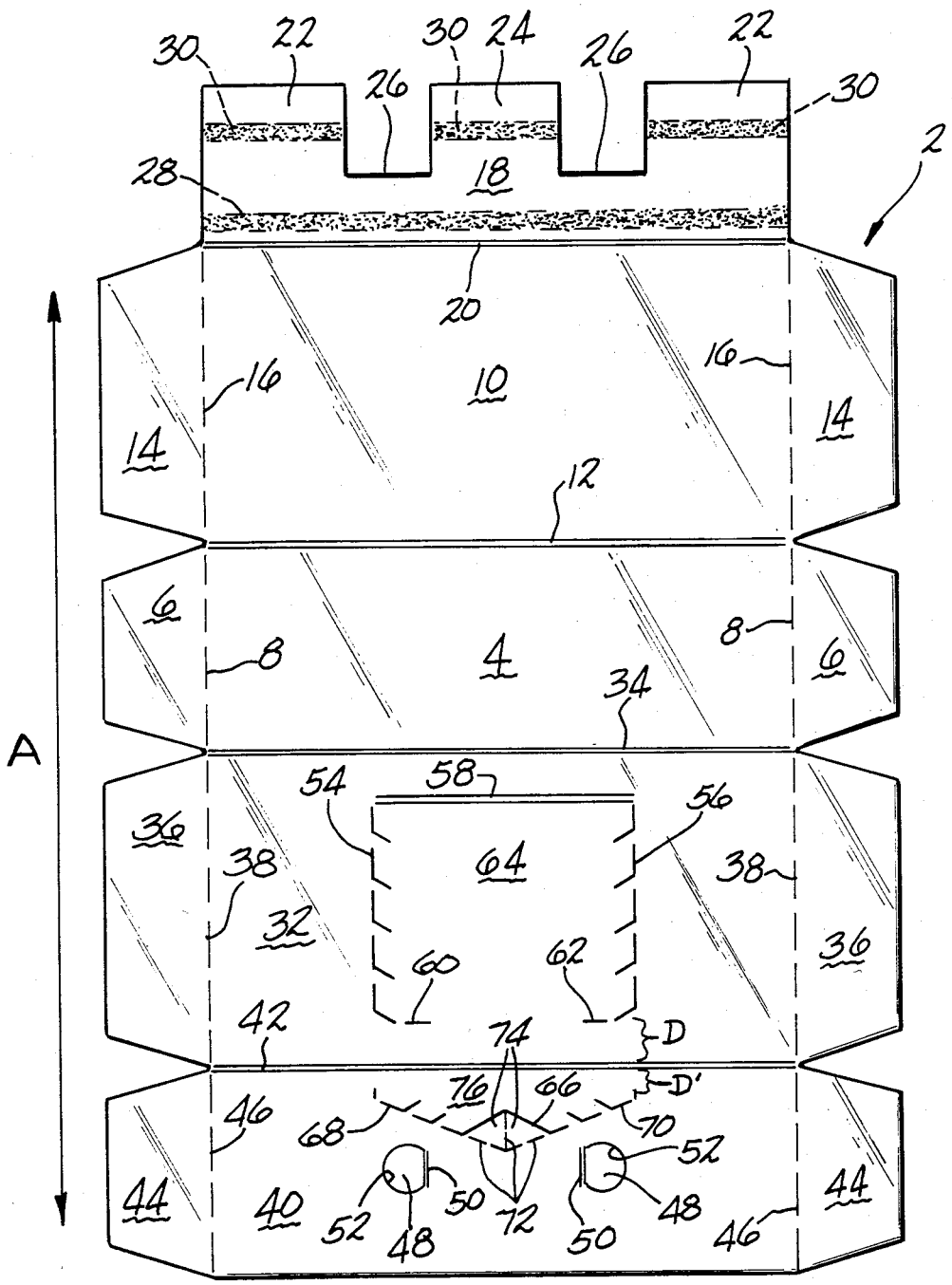
FIG. 1 is a plan view of a preferred embodiment of a pre-cut and scored paperboard blank which is adapted to be erected into a carton formed in accordance with this invention.

Referring now to the drawings, there is shown in FIG. 1 a precut and scored blank, denoted generally by the numeral 2, which blank 2 includes bottom wall 4 having end closure flaps 6 connected to either end thereof along fold lines 8. The grain of the paperboard from which the blank 2 is formed runs in the direction of the arrow A. A first side wall 10 is foldably connected to one side of said bottom wall 4 by a fold line 12 and has end closure flaps 14 foldably connected to either end thereof by fold lines 16. An inner top wall panel 18 is connected to a top edge of the first side wall 10 by a fold line 20. The free edge of the inner top wall panel 18 is contoured so as to provide three projecting tabs comprising end tabs 22 and a medial tab 24. Intervening recesses 26 are disposed between the tabs 22 and 24. First and second adhesive strips 28 and 30 are disposed on the obverse side of the inner top wall panel 18, the strip 28 being closely adjacent to the fold line 20 and the strip 30 extending across each of the tabs 22 and 24.

A second side wall 32 is connected to the bottom wall 4 by a fold line 34 and has end closure flaps 36 connected to either end thereof along fold lines 38. An outer top wall panel 40 is connected to a top edge of the second side wall 32 by a fold line 42 and has end closure flaps 44 connected to either end thereof by fold lines 46. Push tabs 48 are disposed in the outer top wall panel 40 and connected thereto along fold lines 50 and are deflectable out of the plane of panel 40 to form finger grip openings 52 in the outer top wall panel 40. The second side wall 32 has two arrays of colinear herringbone cut score lines 54 and 56 extending generally parallel to each other from opposite ends of a fold line 58 disposed near the bottom corner fold line 34. The cut scores 54 and 56 extend toward the top corner fold line 42 but terminate short thereof at a pair of convergent cut scores 60 and 62. The latter cut scores 60 and 62 are spaced apart from the fold line 42 by a distance D which is at least 5/16" and preferably no greater than $\frac{7}{8}$"in length. The cut scores 54, 56, 60 and 62 and the fold line 58 define a first portion 64 of an opening panel which portion 64 is contained in the second side wall 32. A generally W-shaped cut score 66 is formed medially of the outer top wall panel 40, and a plurality of divergent herringbone cut scores 68 and 70 extend outwardly from opposite ends of the cut score 66 and toward the fold line 42. The outermost ones of the cut scores 68 and 70 are spaced apart from the fold line 42 by a distance D' which is at least $\frac{1}{2}$" and preferably no greater than $1\frac{1}{2}$". Additional cuts 72 define bendable tabs 74 used to initiate opening of the carton. The cut score lines 66, 68 and 70 combine to define a second portion 76 of the opening panel which second portion 76 is contained in the outer top wall panel 40.

Figure 2:
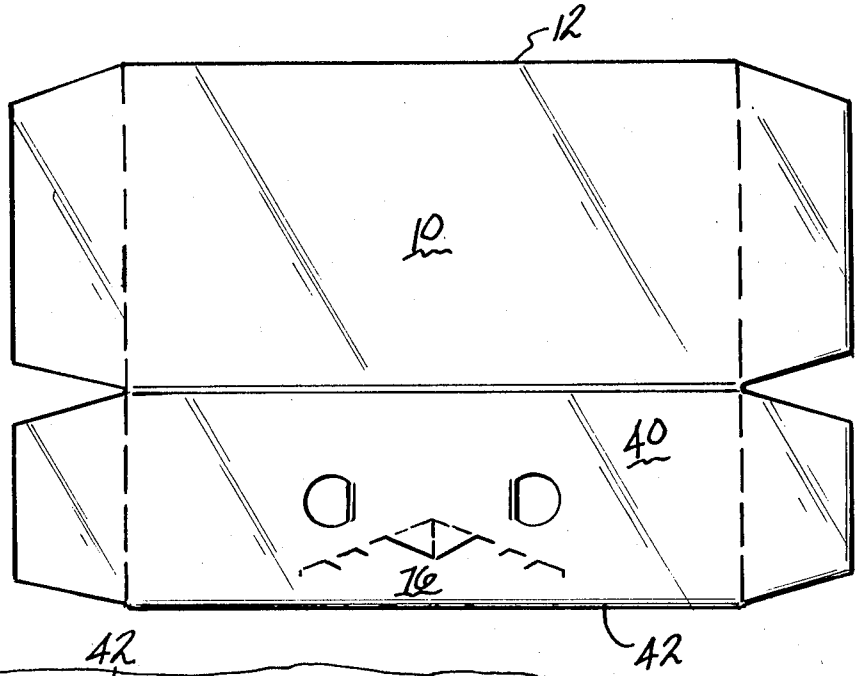
FIG. 2 is a plan view of the blank of FIG. 1 after the latter has been initially folded and glued to form a partially erected flattened bulk shipping configuration of the carton.
Figure 3:
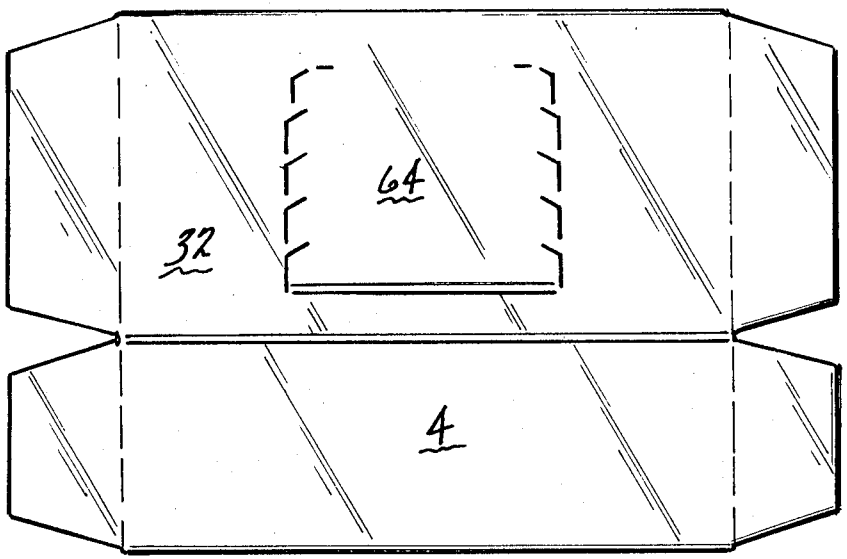
FIG. 3 is a plan view of the obverse side of the folded blank of FIG. 2.

To form the partially erected flat bulk shipping configuration of the carton, the blank 2 is first folded about the fold line 12 to bring the side wall 10 into overlapping contact with the bottom wall 4 and the side wall 32, and the outer top wall panel 40 is folded about the fold line 42 into overlapping contact with the inner top wall panel 18, whereupon the top wall panels 18 and 40 are adhesively secured together. FIG. 2 shows the portion 76 of the opening panel which is contained in the outer top wall panel 40, and FIG. 3 shows the portion 64 of the opening panel which is contained in the side wall 32.

Figure 4:
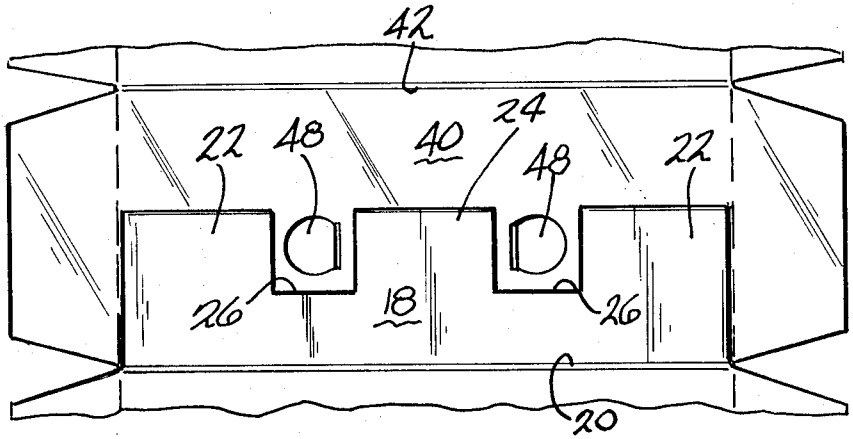
FIG. 4 is a fragmented plan view of the inside surface of the top wall of the blank of FIG. 2.

Referring now to FIG. 4, the inner surface of the two-ply top wall is shown. It will be noted that the end tabs 22 and the medial tab 24 on the inner top wall panel 18 extend toward the fold line 42 past the mid line of the outer top wall panel 40 so that the push tabs 48 are disposed within the confines of the recesses 26 on the inner top wall panel 18. Thus, the weight-bearing medial portion of the top wall of the carton is two-ply in construction. If desired, the end tabs 22 can be eliminated and only the medial tab 24 can be used.

Figure 5:
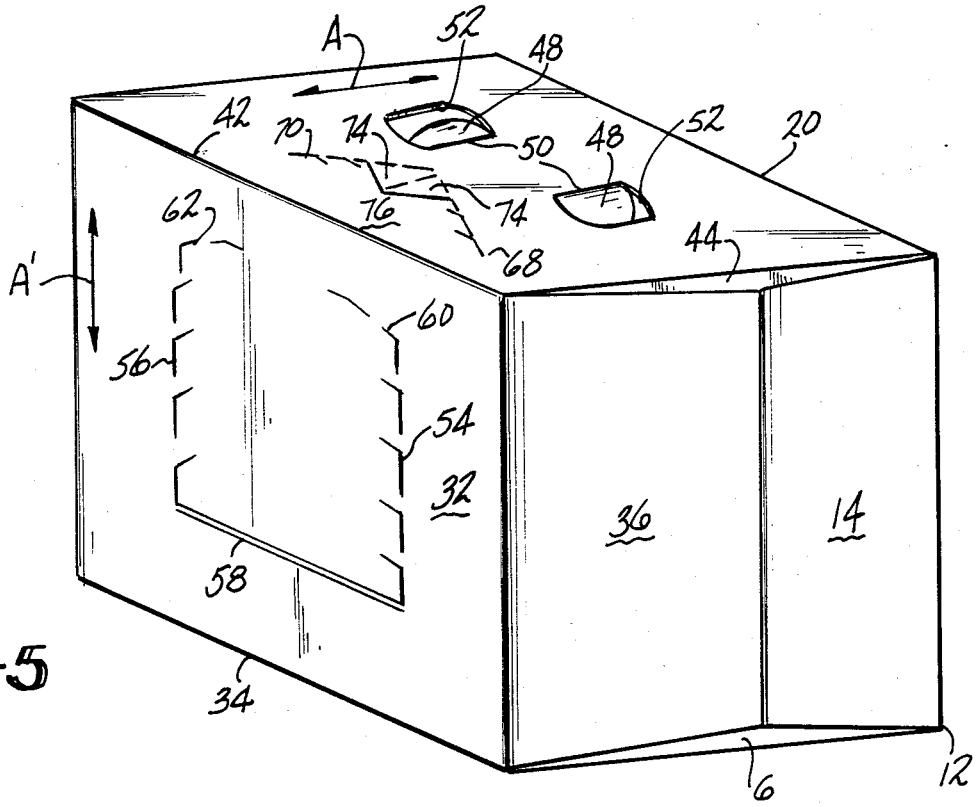
FIG. 5 is a perspective view of the fully erected carton formed from the blank of FIG. 1.

Referring now to FIG. 5, the erected closed carton is shown. The carton is erected by displacing the fold lines 12 and 42 toward each other to expand the carton from the flat form shown in FIGS. 2 and 3 to the rectangular form shown in FIG. 5. The expanded carton is then filled via the open ends, and the end wall flaps 6 and 44 are folded in at right angles to the bottom wall 4 and the outer top wall panel 40 respectively. The end wall flaps 14 and 36 are then folded at right angles to the side walls 10 and 32 respectively and adhesively secured to the underlying end wall flaps 6 and 44. To carry the filled carton, the tabs 48 are pushed into the carton, bending about the fold lines 50 to allow insertion of the fingers in the openings 52. To open the carton, the tabs 74 are bent down into the carton, and the portion 76 of the opening panel is grasped and pulled outwardly. The diverging cut score lines 68 and 70 are thus ruptured. After the outermost cut score lines 68 and 70 rupture, the paperboard material will tear along generally straight lines toward the fold line 42 due to the fact that the grain of the paperboard is perpendicular to the fold lines 20 and 42, as shown by the arrow A. When the tears reach the fold line 42, they then continue along generally parallel lines toward the converging cut score lines 60 and 62 due to the fact that the grain of the paperboard in the side wall 32 is perpendicular to the fold lines 34 and 42, as shown by the arrow A'. When the tears reach the converging cut score lines 60 and 62, the latter rupture toward the cut score lines 54 and 56 which, in turn, rupture toward the fold line 58.

Figure 6:
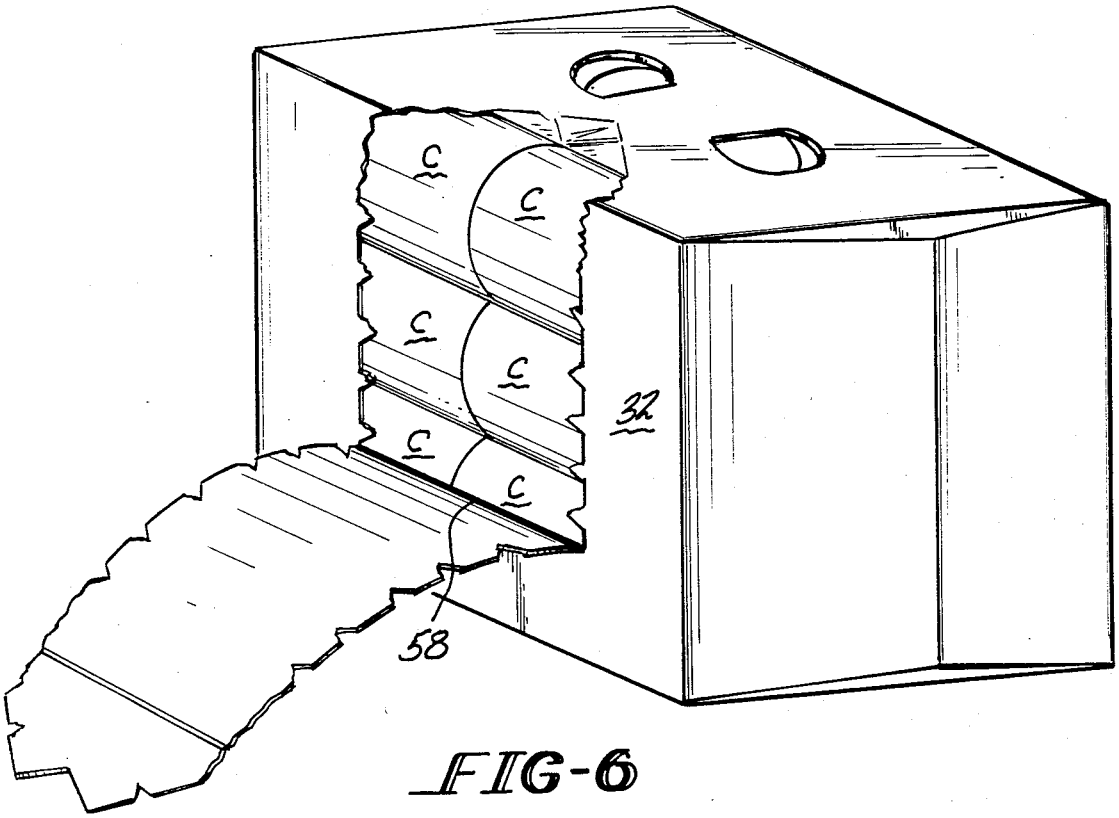
FIG. 6 is a perspective view of the carton of FIG. 1 showing the tear away portion thereof opened to gain access to the contents of the carton.

Referring now to FIG. 6, the carton is shown after the opening panel has been disconnected from the remainder of the carton and swung away from the side wall 32 about the fold line 58. When the carton is thus opened, the cans C are accessible and can be removed singly from the carton. It will be apparent that the opening panel can be reclosed, and its location in the top and side walls allows the carton to be safely transported after being opened with minimal probability that cans will accidentally fall out of the carton.

It will be readily appreciated that the carton of this invention is of utmost simplicity of design and yet provides adequate strength and ease of opening. The opening panel is conveniently positioned and allows ready access to the contents of the carton. The fact that the opening panel extends into two adjacent panels does not weaken the carton structure so as to cause buckling of the fold line interconnecting the two adjacent panels due to the fact that the cut score lines defining the opening panel are terminated a distance away from the fold line, which distance is at least 5/16" in the side wall and ½" in the top wall. The paperboard between the arrays of cut score lines in each of the adjacent panels tears across the fold line in relatively straight lines due to the orientation of the grain of the paperboard used to make the carton.

Since many changes and variations of the disclosed embodiment of the invention may be made without departing from the inventive concept, it is not intended to limit the invention otherwise than as required by the appended claims.

What is claimed is:

1. A paperboard carton for holding a plurality of beverage cans, said carton comprising:

(a) side, bottom and top walls foldably connected together to form a tubular container;

(b) end flaps foldably connected to end edges of said walls and overlapped and secured to each other to form end closures for said container;

(c) said top wall comprising an outer top wall panel foldably connected to one of said side walls, said outer top wall panel including means forming centrally disposed finger openings in said outer top wall panel;

(d) said top wall further comprising an inner top wall panel foldably connected to the other of said side walls, said inner top wall panel underlying and being adhesively secured to an inner surface of said outer top wall panel to provide a medial weight-bearing portion of said top wall which is two-ply in construction, and said inner top wall panel having an inner free edge which includes a medial tab which extends between said finger openings and which is flanked by recesses providing for insertion of fingers through said finger openings into the interior of said container;

(e) an opening panel comprising a first portion disposed in said one of said side walls, opposite ends of said first portion being defined by two generally parallel arrays of cut score lines extending toward said top wall with bottom extremities of said arrays being interconnected by a hinged fold line which is parallel to and spaced upwardly from said bottom wall, said generally parallel arrays of cut score lines merging into respective series of converging cut score lines, with the uppermost one of each series of merging cut score lines being spaced apart from 5/16 inch to ⅞ inch from the fold interconnecting said first side wall and said outer top wall panel, said opening panel further comprising a second portion disposed in said outer top wall panel, said second portion being defined by diverging cut score lines which diverge from a common apex toward said end closures of said container, the outermost ones of said diverging cut score lines being disposed substantially colinearly with said generally parallel arrays of cut score lines and being spaced apart from ½ inch to 1⅛ inches from said fold interconnecting said one side wall and said outer top wall panel, there being flanking shearing marginal portions of said opening panel extending between said converging and diverging cut score lines; and (f) the grain of the paperboard in said outer top wall panel and said one side wall being generally parallel to said end closures to facilitate linear shearing of said shearing marginal portions of said opening panel when the latter is pulled away from the remainder of the container to open the carton.

2. A paperboard carton for holding a plurality of beverage cans, said carton comprising:

(a) side, bottom and top walls foldably connected together to form a tubular container;

(b) end flaps foldably connected to end edges of said walls and overlapped and secured to each other to form end closures for said container;

(c) said top wall including handle means whereby the container can be manually carried, and said top and bottom walls being connected to one of said side walls along side fold lines;

(d) an opening panel comprising a first portion disposed in said one of said side walls, opposite ends of said first portion being defined by two generally parallel arrays of cut score lines extending toward one of said top and bottom walls with basal extremities of said arrays being interconnected by a hinge line, said generally parallel arrays of cut score lines merging into respective series of converging cut score lines, with the uppermost one of each series of merging cut score lines being spaced apart from one of said side fold lines a distance in the range of about 5/16 inch to about $\frac{7}{8}$ inch, and said opening panel further comprising a second portion disposed in said one of said top and bottom walls, said second portion being defined by diverging cut score lines which diverge from a common apex toward said end closures of said container, the outermost ones of said diverging cut score lines being disposed substantially colinearly with said generally parallel arrays of cut score lines and being spaced apart from said one side fold line a distance in the range of about $\frac{1}{2}$ inch to about $1\frac{1}{8}$ inches, there being shearing marginal portions of said opening panel extending between corresponding ones of said converging and diverging cut score lines and across said one side fold line; and (e) the grain of the paperboard in said one of said top and bottom walls and said one side wall being generally parallel to said end closures to facilitate linear shearing of said shearing marginal portions of said opening panel when the latter is pulled away from the remainder of the container to to open the carton.

* * * * *